US006146168A

United States Patent [19]

Ishii

[11] Patent Number: 6,146,168

[45] Date of Patent: Nov. 14, 2000

[54] CONNECTOR STRUCTURE

[75] Inventor: Yoshiharu Ishii, Yokohama, Japan

[73] Assignee: Yamaichi Electronics Co., Ltd., Tokyo, Japan

[21] Appl. No.: 09/301,587

[22] Filed: Apr. 29, 1999

[30] Foreign Application Priority Data

Dec. 10, 1998 [JP] Japan ..... 10-351879

[51] Int. Cl.[7] ..... H01R 29/00

[52] U.S. Cl. ..... 439/188; 439/63; 439/944

[58] Field of Search ..... 439/188, 581, 439/63; 200/51.09, 1 R, 283, 504, 5.111, 51.1; 361/733

[56] References Cited

U.S. PATENT DOCUMENTS

| | | | |
|---|---|---|---|
| 617,464 | 1/1899 | Holmes | 200/51.1 |
| 3,949,180 | 4/1976 | Ojima et al. | 200/51.09 |
| 4,633,048 | 12/1986 | Komatsu | 200/51.1 |
| 4,647,127 | 3/1987 | Weingartner . | |
| 4,657,327 | 4/1987 | Weingartner . | |
| 4,786,258 | 11/1988 | Shaffer et al. | 439/188 |
| 5,625,177 | 4/1997 | Yukinori et al. | 200/1 R |

FOREIGN PATENT DOCUMENTS

| | | |
|---|---|---|
| 59-5578 | 1/1984 | Japan . |
| 2-99582 | 8/1990 | Japan . |
| 2-133882 | 11/1990 | Japan . |
| 8-153557 | 6/1996 | Japan . |
| 9-147997 | 6/1997 | Japan . |

*Primary Examiner*—Neil Abrams
*Assistant Examiner*—J. F. Duverne
*Attorney, Agent, or Firm*—Wenderoth, Lind & Ponack, L.L.P.

[57] ABSTRACT

A connector structure has a second connector fitted to an interior of a cylindrical receiving port of a first connector such that the first and second connectors can be electrically connected together in an inner region of the cylindrical receiving port. A fitting portion of the second connector exhibits a generally square configuration, four corner portions of the square fitting portion are each defined as an arcuate corner portion arranged on an inscribed circle of the cylindrical receiving port and having the same radius of curvature as the inscribed circle, an arcuate surface of each of the four arcuate corner portions is in inscribed relation to an inner peripheral surface of the cylindrical receiving port, and four side portions between adjacent arcuate corner portions are located away from the inner peripheral surface of the cylindrical receiving port.

3 Claims, 5 Drawing Sheets

CONNECTOR STRUCTURE

BACKGROUND OF THE INVENTION

This invention relates to a connector structure in which a second connector is fitted to an interior of a cylindrical receiving port of a first connector such that the first and second connectors can be electrically connected together in an inner region of the cylindrical receiving port.

In Japanese Patent Unexamined Publication (Kokai) No. Hei 8-153557, there is disclosed a connector structure in which a cylindrical fitting portion of a second connector mounted on a wiring circuit board is fitted to an interior of a cylindrical receiving port of a first connector such that they can be electrically connected together in inner regions of the respective cylindrical receiving ports.

The above connector structure has the following shortcomings. Because the second connector is circular, the square region substantially circumscribing the circle forms a dead space. This dead space badly degrades the mounting efficiency of a given electronic part on a wiring circuit board (first problem). In case of a portable telephone, for example, where miniaturization is a main target to be achieved, improvement is demanded.

Also, in the above Japanese Patent Unexamined Publication No. Hei 8-153557, a cylindrical receiving port of the first connector is provided with slits so that it can be dilated and contracted, and a cylindrical fitting portion of the second connector is pushed into the slit of the cylindrical receiving port so that an inwardly projecting locking projection formed on an end portion of the receiving port is locked to a locking groove formed in an outer peripheral surface of the cylindrical fitting portion, thereby retaining a connection between the first connector and the second connector.

Because of the above arrangement, this prior art device has the following additional shortcomings. Since the locking projection is locked to the locking groove by only resiliency of the receiving port component pieces defined between the slits, the locking projection is liable to be unlocked from the locking groove by tensile force. In order to prevent this unfavorable occurrence, it would be necessary to increase the locking force of the receiving port component pieces. However, if the locking force should be increased, the operational force for locking and unlocking the locking projection with respect to the locking groove would be overly increased (second problem).

In the prior art including the above, when the cylindrical fitting portion is fitted to an interior of the cylindrical receiving portion of the first connector, an ground contact is achieved at this fitting surface. Here again, if the operational force for fitting should be reduced, a reliable electrical connection would be degraded. If the fitting portion should be strengthened in order to reduce the operational force for fitting, the operational force for locking/unlocking would be overly increased as mentioned (third problem). This problem is attributable to the arrangement in which connection between the first connector and the second connector and ground thereof depend on the fitting portion.

The present invention has been accomplished in order to overcome the above-mentioned shortcomings of the conventional devices.

SUMMARY OF THE INVENTION

It is, therefore, an object of the present invention to provide an improved connector structure capable of providing a reliable electrical connection.

Another object of the present invention is to provide an improved connector structure in which mounting efficiency is enhanced.

To achieve the above objects, according to one aspect of the invention, there is essentially provided a connector structure in which a second connector is fitted to an interior of a cylindrical receiving port of a first connector such that the first and second connectors can be electrically connected together in an inner region of the cylindrical receiving port. A fitting portion of the second connector exhibits a generally square configuration, four corner portions of the square fitting portion are each defined as an arcuate corner portion arranged on an inscribed circle of the cylindrical receiving port and having the same radius of curvature as the inscribed circle, an arcuate surface of each of the four arcuate corner portions is in inscribed relation to an inner peripheral surface of the cylindrical receiving port, and four side portions between adjacent arcuate corner portions are located away from the inner peripheral surface of the cylindrical receiving port.

According to another aspect of the present invention, there is also provided a connector structure in which a second connector is fitted to an interior of a cylindrical receiving port of a first connector such that the first and second connectors can be electrically connected together in an inner region of the cylindrical receiving port. A plurality of slits extending axially and reaching an end face of the receiving port are circumferentially spacedly formed in a peripheral surface of the cylindrical receiving port. A locking projection projecting inwardly is formed on an inner peripheral surface of an end portion of each of a plurality of receiving port component pieces divided by the slits. A fitting portion of the second connector is brought into abutment with the inwardly projecting locking portion of each of the receiving port component pieces to dilate the receiving port component pieces and fitted to an interior of the cylindrical receiving port such that the receiving port component pieces are closed by a tail end of the fitting portion so that the inwardly projecting locking projection is locked to the fitting portion. A dilation preventive member is vertically movably fitted to an outer peripheral surface of the cylindrical receiving port such that dilation of the receiving port component pieces is prevented when the dilation preventive member moves downwardly, thereby retaining a connected relation between the first connector and the second connector.

According to a further aspect of the present invention, there is also provided a connector structure in which a second connector is fitted to an interior of a cylindrical receiving port of a first connector such that the first and second connectors can be electrically connected together in an inner region of the cylindrical receiving port by a signal terminal between the first connector and the second connector. A grounding ring provided on the first connector is placed, in overlapping relation, on a grounding seat piece provided on the second connector in a plane perpendicular to an axis. The grounding ring and the grounding seat piece are pressed by a spring provided on the first connector so that the first and second connectors are electrically connected through overlapped surfaces thereof.

A more complete application of the invention and many of the attendant advantages thereof will be readily obtained as the same becomes better understood by reference to the following detailed description when considered in connection with the accompanying drawings.

DETAILED DESCRIPTION OF THE PRESENT INVENTION

Figure 1:
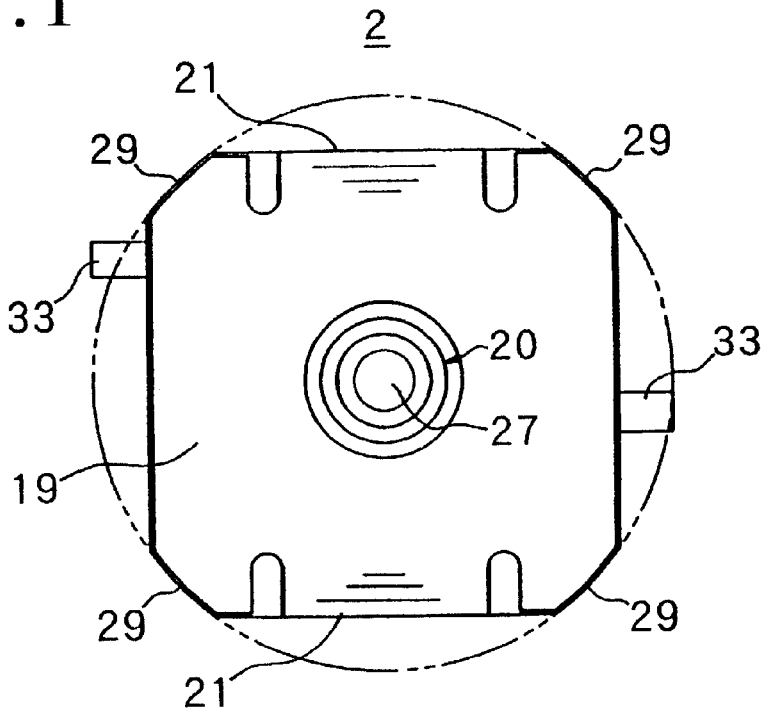
FIG. 1 is a plan view of a second connector embodying the present invention.
Figure 2:
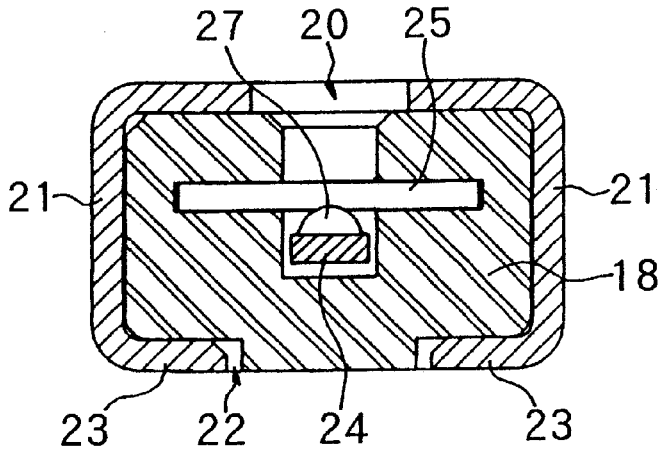
FIG. 2 is a vertical sectional view of FIG. 1.
Figure 3:
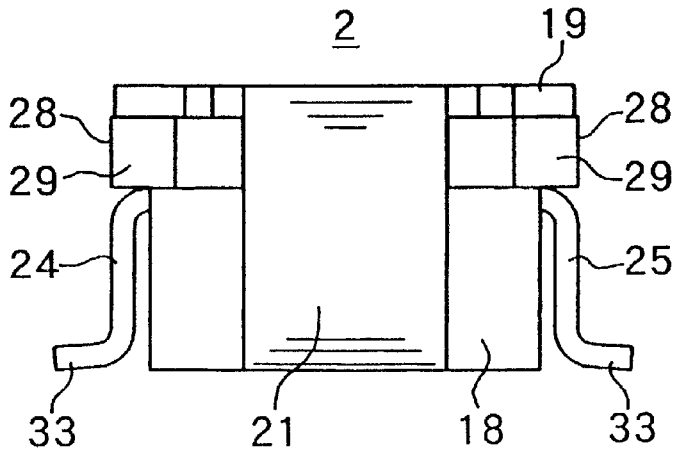
FIG. 3 is a side view of FIG. 1.
Figure 4:
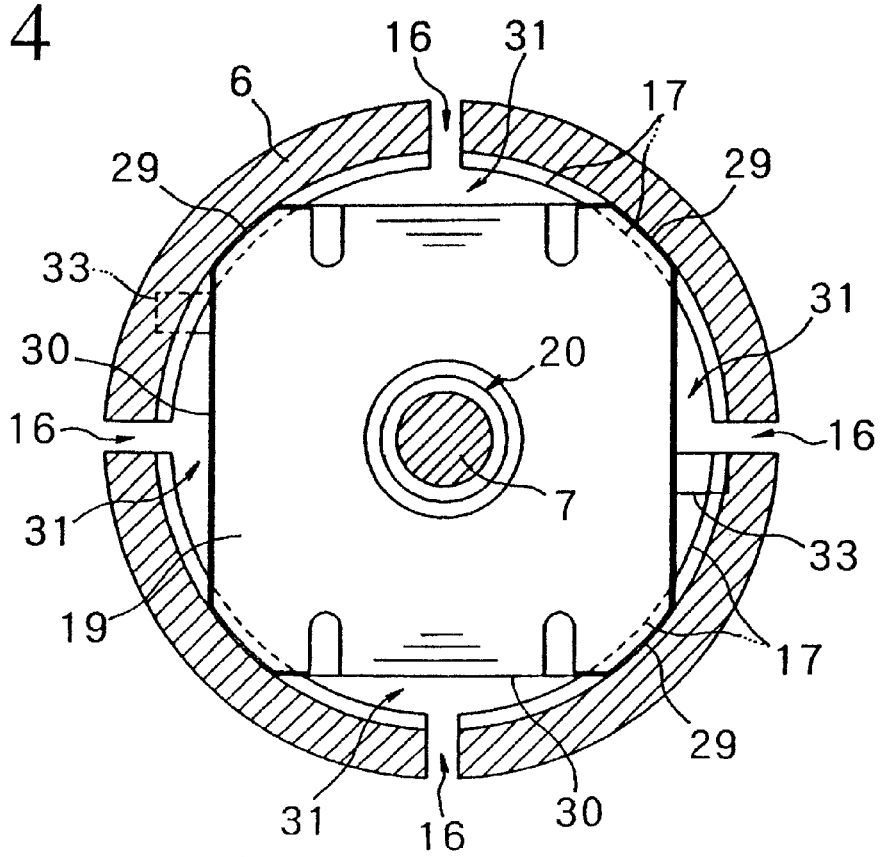
FIG. 4 is a cross sectional view showing a fitted state of the first and second connectors.
Figure 5:
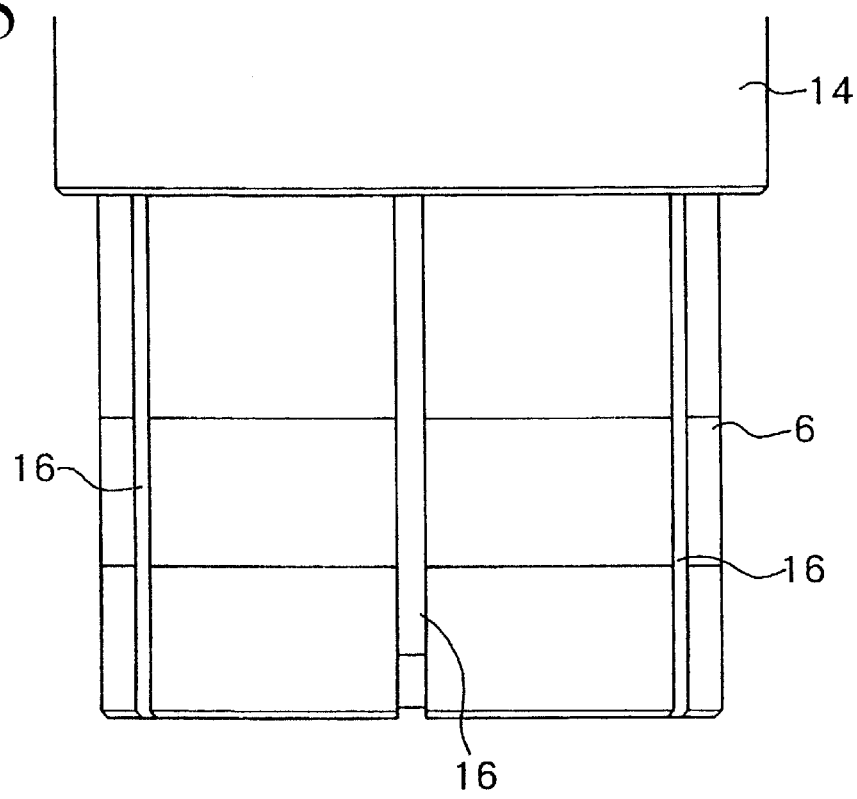
FIG. 5 is a side view of a cylindrical receiving port portion of the first connector.
Figure 6:
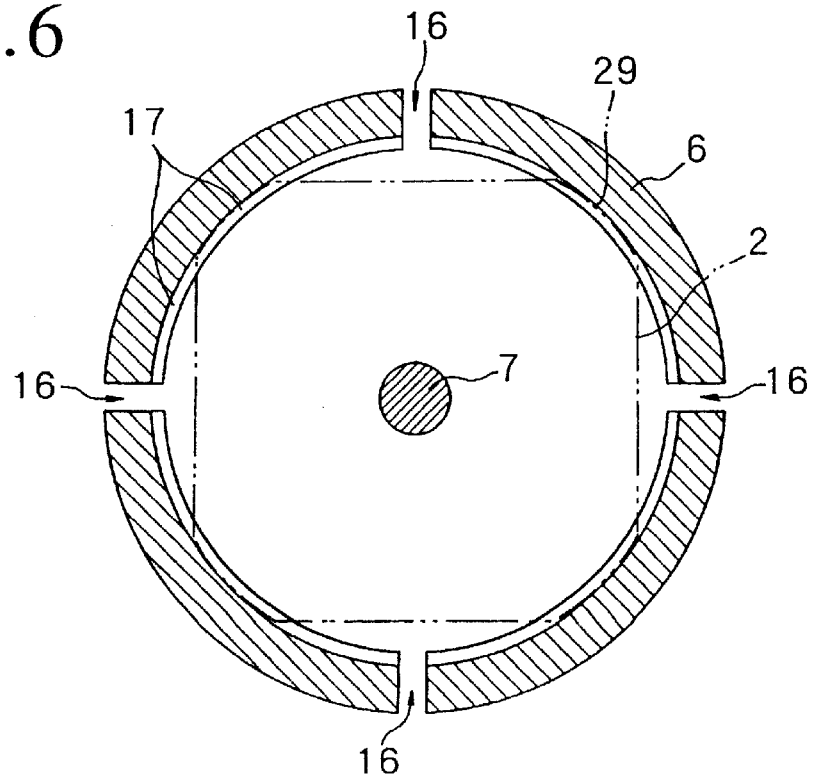
FIG. 6 is a cross sectional view of the first connector.
Figure 7:
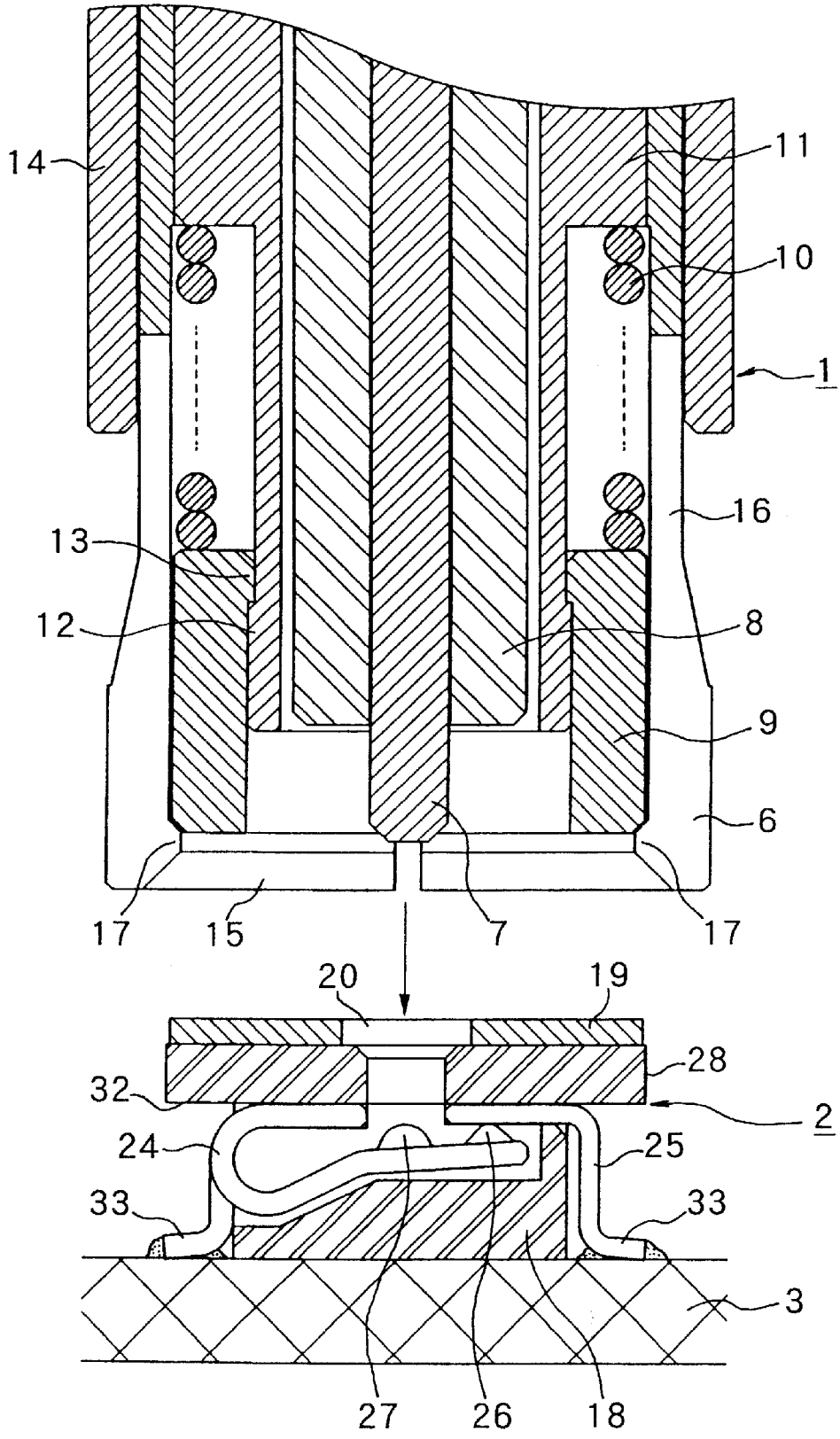
FIG. 7 is a vertical sectional view showing a state before the first and second connectors are fitted.

As shown in FIGS. 1 through 9, a first connector 1 constitutes a test probe, and a second connector 2 constitutes a switch connector of a transmitting/receiving circuit 4 mounted on a wiring circuit board 3.

Figure 8:
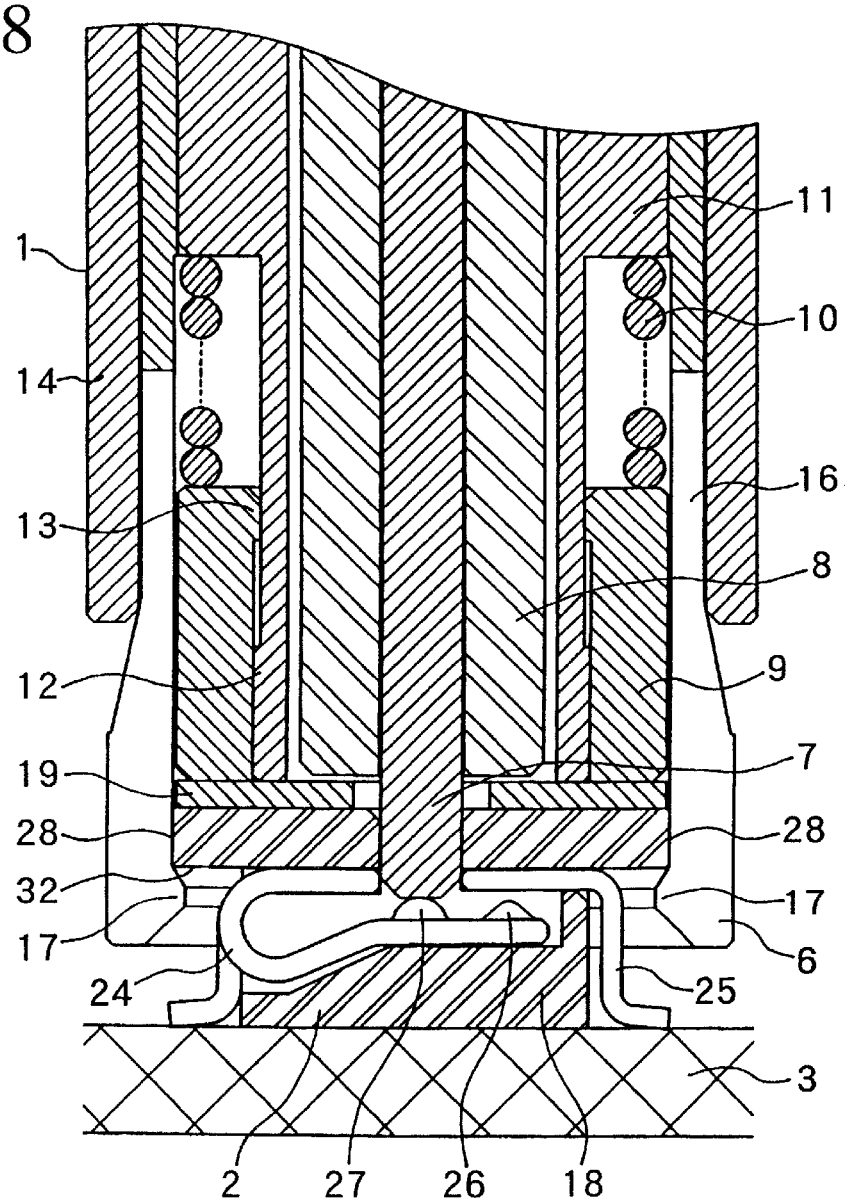
FIG. 8 is a vertical sectional view showing a state after the first and second connectors are fitted.
Figure 9:
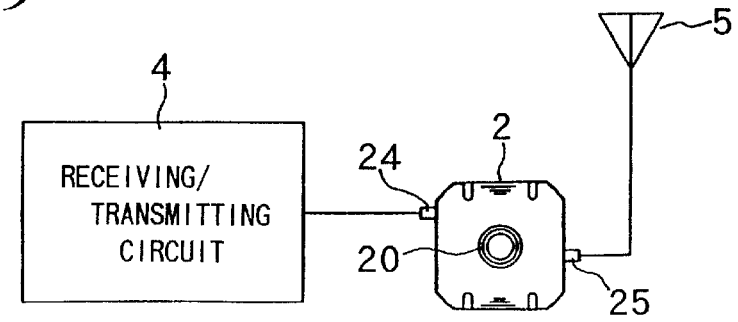
FIG. 9 is a switch circuit diagram composed of an antenna, a transmitting/receiving circuit and a second connector.

As shown in FIG. 8, the first connector 1 and the second connector 2 are connected together to switchingly bring the transmitting/receiving circuit 4 into open position with respect to an antenna 5 and open position with respect to the test probe. This connector structure is applicable to a communication device such as a portable telephone or the like.

The connector 1 includes a cylindrical receiving port 6 formed in a distal end thereof, a signal pin terminal 7 disposed at a central region within the cylindrical receiving port 6 and a grounding ring 9 disposed concentrically of the pin terminal 7 through an insulative material 8. The cylindrical receiving port 6 surrounds an outer periphery of the grounding ring 9.

The grounding ring 9 is axially resiliently held by a coil spring 10 which surrounds the insulative material 8 such that it is normally biased towards an opening surface of the cylindrical receiving port 6, i.e., in a direction for connection with the second connector 2.

In order to prevent the grounding ring 9 from escaping, a locking sleeve 11 is concentrically disposed inwardly of the grounding ring 9 in such a manner as to surround the pin. terminal 7. A locking pawl 13 formed on an end portion on of the grounding ring 9 is engageable with an annular locking pawl 12 disposed on an end portion of the locking sleeve 11 nearest to the receiving port, to form a stopper for resisting the effect of the coiled spring 10 thereby preventing escape of the grounding ring from the interior of the receiving port. The grounding ring 9 can move on the axis upwardly (in a direction away from the receiving port opening surface) while compressing the coiled spring 10 and it can move on the axis downwardly (in a direction approaching the receiving port opening surface) under the effect of the coiled spring 10. This low limit position is retained by the stopper.

A cylindrical dilation preventive member 14 is vertically movably fitted to an outer peripheral surface of the cylindrical receiving port 6 such that dilation of the receiving port component pieces 15 is prevented when the cylindrical dilation preventive member 14 is moved downwardly to a dilation preventing position and dilation of the receiving port component pieces 15 is allowed when the receiving port component pieces 15 is moved upwardly to a dilation allowing position.

That is, a plurality of slits 16 extending axially and reaching an end face of the cylindrical receiving port 6 are circumferentially spacedly formed in a peripheral surface of the cylindrical receiving port 6 so that the receiving port component pieces 15 divided by the slits 16 can displace outwardly against resiliency thereof and inwardly under the effect of resiliency thereof. This makes it possible for the cylindrical receiving port 6 to be dilated and contracted.

Inwardly projecting locking projections 17 are formed on an inner peripheral surface of an end portion of each of the receiving port component pieces 15 divided by the slits 16.

As one example, the locking projections 17 are arranged, in an annular pattern, on an inner peripheral surface of a lower end of the cylindrical receiving port 6. The cylindrical receiving port 6 is divided by the slits 16 to form the locking projections 17 on the inner peripheral surface of each receiving port component piece 15. Thus, the locking projections are continuous in an annular pattern through the slits 16.

On the other hand, an insulative connector body 18, which forms a housing of the second connector 2, is fitted to an interior of the cylindrical receiving port 6 of the first connector 1 such that a fitting portion 28 exhibits a generally square configuration. Four corner portions of the square fitting portion 28 are each defined as an arcuate corner portion 29 arranged on an inscribed circle of the cylindrical receiving port 6 and having the same radius of curvature as the inscribed circle. An arcuate surface of each of the four arcuate corner portions 29 is in inscribed relation to an inner peripheral surface of the cylindrical receiving port 6, and four side portions 30 between adjacent arcuate corner portions 29 are located away from the inner peripheral surface of the cylindrical receiving port 6, thus forming an arcuate cavity 31.

An grounding seat piece 19 is formed on an upper surface of the insulative connector body 18 (i.e., on an upper surface of the fitting portion 28) such that the grounding seat piece 19 is, in parallel relation, confronting an opening surface of the cylindrical receiving port 6. That is, the grounding seat piece 19 forms an annular plane perpendicular to an axis of the pin terminal 7.

The grounding seat piece 19 has a pin terminal insertion hole 20 at its central region. This pin terminal insertion hole 20 is concentric with the pin terminal 7.

One pair of grounding terminal pieces 21 integrally extends from a peripheral edge portion of the grounding seat piece 19 along opposing side surfaces of the connector body 18. A lower end of the grounding terminal piece 21 is bent inwardly to fit to a stepped portion 22 formed on a lower surface of the connector body 18, thereby retaining the grounding seat piece 19 on the connector body 18. A surface mounting piece 23 is formed by the inwardly bent piece of the grounding terminal piece 21. The grounding terminal piece 21 is mounted on a circuit pattern of the wiring circuit board 3 by soldering or the like through the surface mounting piece 23.

A signal contact is disposed within the connector body 18, that is, immediately below the grounding seat piece 19. This signal contact is composed of a first contact piece 24 to be connected to the transmitting/receiving circuit 4 and a second contact piece 25 to be connected to the antenna 5. The first and second contact pieces 24, 25 are each integrally provided on an external end thereof with a surface mounting piece 33. The surface mounting piece 33 is connected to the wiring circuit board 3 by soldering or the like and mounts the second connector 2 on the wiring circuit board 3 in cooperation with the surface mounting piece 23.

The first and second contact pieces 24, 25 are allowed to extend generally horizontally so that they are intersected with an axis of the pin terminal 7 from mutually opposite directions, with inner ends thereof vertically confronted with each other. The first contact piece 24 is normally resiliently contacted, under pressure, with the second contact piece 25 through a first projection 26 formed on a confronting surface of the first contact piece 24 which is located in a position lower than the second contact piece 25. By this, the transmitting/receiving circuit 4 is connected to the antenna 5.

The first contact piece 24, which is disposed immediately below the insertion hole 20 of the pin terminal 7, is confronted with a distal end of the pin terminal 7, that is, confronted with the pin terminal 7 and its insertion hole 20, so that a second projection 27 is formed on this confronting portion.

When the fitting portion 28 of the second connector 2 is fitted to an interior of the cylindrical receiving port 6 of the first connector 1, the pin terminal 7 is inserted into the insertion hole 20. Then, the second projection 27 is pushed by a distal end portion of the pin terminal 7 to deflect the first contact piece 24 downwardly so that the first projection 26 is brought away from the second contact piece 25 to open the antenna 5 and the transmitting/receiving circuit 4 and close the transmitting/receiving circuit 4 and the contact pin 7 through the first contact piece 24. The pin terminal 7 is connected to a test circuit to carry out a test.

In the above connector structure, the fitting portion 28 of the second connector 2 is fitted to an interior of the cylindrical receiving port 6 of the first connector 1, thereby achieving the electrical connection between the first connector and the second connector at an inner region of the cylindrical receiving port 6.

The fitting portion 28 of the second connector 2 is formed in a generally square configuration. The four corner portions of the square fitting portion 28 are each defined as an arcuate corner portion arranged on an inscribed circle of the cylindrical receiving port 6 and having a same radius of curvature as the inscribed circle. An arcuate surface of each of the four arcuate corner portions is in inscribed relation to an inner peripheral surface of the cylindrical receiving port 6. Thus, the four side portions between adjacent arcuate corner portions are located away from the inner peripheral surface of the cylindrical receiving port 6, thereby forming an arcuate cavity 31.

By this, the dead space, as had in the prior art when the second connector is mounted on the wiring circuit board, can be reduced considerably and the mounting efficiency can be enhanced. In this case, the reduced area is as large as ½ or more of the square configuration circumscribing the conventional cylindrical fitting portion and therefore, the above-mentioned first problem can be solved.

Also, in the above mutually fitting connector structure, the plurality of slits 16 extending axially and reaching an end face of the cylindrical receiving port 6 are circumferentially spacedly formed in the peripheral surface of the cylindrical receiving port 6 and a locking projection projecting inwardly is formed on an inner peripheral surface of an end portion of each of the receiving port component pieces 15 divided by the slits 16.

The fitting portion 28 of the second connector 2 is brought into abutment with the inwardly projecting locking portion 17 of each of the receiving port component pieces 15 to dilate the receiving port component pieces 15 and fitted to an interior of the cylindrical receiving port 6 such that the receiving port component pieces 15 are resiliently restored and contracted by a tail end of the fitting portion so that the annular inwardly projecting locking projection 17 is locked to a stepped portion 32 formed on a lower surface of each arcuate corner portion 29. A dilation preventive member 14 is vertically movably fitted to an outer peripheral surface of the cylindrical receiving port 6 such that dilation of the receiving port component pieces 15 is prevented when the dilation preventive member 14 moves downwardly, thereby retaining a connected relation between the first connector 1 and the second connector 2.

By this, a reliable connection between the first connector 1 and the second connector 2 can be ensured while reducing the fitting operational force of the receiving port 6. Thus, the conventional problem, in which a sufficient connecting force (i.e., locking force) is unobtainable when the fitting operational force is reduced, can be solved effectively.

In the above mutually fitting connector structure, the grounding ring 9 provided on the first connector 1, when the first and second connectors 1, 2 are connected together, is placed, in overlapping relation, on the grounding seat piece 19 provided on the second connector 2 in a plane perpendicular to the axis, and the grounding ring 9 and the grounding seat piece 19 are pressed by the coiled spring 10 provided on the first connector 1 so that the first and second connectors 1, 2 are electrically connected through overlapped surfaces thereof. By this, reliability can be enhanced by obtaining a sufficient grounding contact pressure while reducing the fitting operational force. Thus, the above-mentioned third problem in the prior art can be solved effectively.

According to the present invention, the dead space, as had in the prior art when the second connector is mounted on the wiring circuit board, can be reduced considerably and the mounting efficiency can be enhanced. In this case, the reduced area is as large as ½ or more of the square configuration circumscribing the conventional cylindrical fitting portion and therefore, the above-mentioned first problem can be solved.

Also, a reliable connection between the first and second connectors can be ensured while reducing the fitting operational force of the receiving port. Thus, the conventional problem, in which a sufficient connecting force (i.e., locking force) is unobtainable when the fitting operational force is reduced, can be solved effectively.

Also, reliability can be enhanced by obtaining a sufficient grounding contact pressure while reducing the fitting operational force. Thus, the above-mentioned third problem in the prior art can be solved effectively.

Obviously, numerous modifications and variations of the present invention are possible in light of the above teachings. It is therefore to be understood that within the scope of the appended claims, the invention may be practiced otherwise than as specifically described herein.

What is claimed is:

1. A connector structure comprising a first connector including a cylindrical receiving port, and a second connector including a generally square fitting portion, wherein said second connector is fitted to an interior of said cylindrical receiving port of said first connector such that said first and second connectors can be electrically connected together in an inner region of said cylindrical receiving port, wherein four corner portions of said square fitting portion are each defined as an arcuate corner portion arranged on an inscribed circle of said cylindrical receiving port and having a same radius of curvature as said inscribed circle, wherein an arcuate surface of each of said four arcuate corner portions is in inscribed relation to an inner peripheral surface of said cylindrical receiving port, and wherein four side portions between adjacent arcuate corner portions are located away from the inner peripheral surface of said cylindrical receiving port.

2. A connector structure comprising a first connector including a cylindrical receiving port, and a second connector including a fitting portion, wherein said second connector is fitted to an interior of said cylindrical receiving port of said first connector such that said first and second connectors can be electrically connected together in an inner region of said cylindrical receiving port, wherein a plurality of slits extending axially and reaching an end face of said receiving port are circumferentially spacedly formed in a peripheral surface of said cylindrical receiving port so as to define a plurality of receiving port component pieces therebetween, wherein a locking projection projecting inwardly is formed on an inner peripheral surface of an end portion of each of said receiving port component pieces divided by said slits, a fitting portion of said second connector is movable into abutment with said inwardly projecting locking portion of each of said receiving port component pieces to dilate said receiving port component pieces and is fittable to an interior of said cylindrical receiving port such that said receiving port component pieces are closed by a tail end of said fitting portion so that said inwardly projecting locking projection is locked to said fitting portion, and wherein a dilation preventive member is axially movably fitted to an outer peripheral surface of said cylindrical receiving port for movement between a dilation preventing position and a dilation allowing position such that dilation of said receiving port component pieces is prevented when said dilation preventive member is moved axially to said dilation preventing position, thereby retaining a connected relation between said first connector and said second connector.

3. A connector structure according to claim 2, wherein said second connector is fitted to the interior of said cylindrical receiving port of said first connector such that said first and second connectors can be electrically connected together in an inner region of said cylindrical receiving port by a signal terminal between said first connector and said second connector, wherein a grounding ring is provided on said first connector and a grounding seat piece is provided on said second connector, wherein said grounding ring is placed, in overlapping relation, on said grounding seat piece in a plane perpendicular to an axis of said cylindrical receiving port, and wherein a spring is provided on said first connector, and said spring presses said grounding ring and said grounding seat piece toward contact with each other so that said first and second connectors are electrically connected through overlapped surfaces thereof.

* * * * *